US010538865B2

(12) United States Patent
Wang

(10) Patent No.: US 10,538,865 B2
(45) **Date of Patent: *Jan. 21, 2020**

(54) METHOD FOR PRODUCING MULTI-HOLE ULTRA SOFT YARNS

(71) Applicant: LOFTEX USA LLC, New York, NY (US)

(72) Inventor: Hongxing Wang, Shandong (CN)

(73) Assignee: LOFTEX USA LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/270,433

(22) Filed: Sep. 20, 2016

(65) Prior Publication Data

US 2017/0370029 A1 Dec. 28, 2017

Related U.S. Application Data

(60) Provisional application No. 62/355,581, filed on Jun. 28, 2016.

(51) Int. Cl.

| | |
|---|---|
| ***D03D 1/00*** | (2006.01) |
| ***D03D 15/00*** | (2006.01) |
| *D01G 13/00* | (2006.01) |

(52) U.S. Cl.

CPC ..... *D03D 1/0017* (2013.01); *D03D 15/00* (2013.01); *D01G 13/00* (2013.01); *D10B 2201/02* (2013.01); *D10B 2321/06* (2013.01); *D10B 2401/024* (2013.01)

(58) Field of Classification Search

CPC .. D01D 5/24; D01H 7/76; D01H 7/86; D02G 3/28; D02G 3/36; D02G 3/362

See application file for complete search history.

(56) References Cited

U.S. PATENT DOCUMENTS

| | | | | | |
|---|---|---|---|---|---|
| 2,503,987 | A * | 4/1950 | Anderson | D07B 7/02 | 57/138 |
| 2,540,833 | A * | 2/1951 | Pitt | D07B 7/02 | 57/138 |
| 2,724,944 | A * | 11/1955 | Carleton | D07B 3/04 | 57/138 |
| 3,872,659 | A * | 3/1975 | Campbell | D07B 1/0693 | 57/33 |
| 3,952,372 | A * | 4/1976 | Howell, Jr. | D01H 5/18 | 19/238 |
| 3,994,046 | A * | 11/1976 | Brown | D01H 5/72 | 19/150 |

(Continued)

OTHER PUBLICATIONS

Kathryn L. Hatch, Textile Science, 1993 West Publishing Company, 1st edition, p. 272.*

*Primary Examiner* — Shaun R Hurley

(74) *Attorney, Agent, or Firm* — Leason Ellis LLP

(57) ABSTRACT

The present invention provides a method for successively introducing water soluble fibers into finish fibers (e.g. cotton) to produce a hollow and ultra soft structure, by introducing water soluble slivers into the center of a multi-hole feeder with multiple cotton fiber slivers arranged around the water soluble fiber in a pre-drawing process via a multi-hole sliver feeder. A plurality of these fibers can be drawn together to produces a fiber having multiple water soluble fibers. A cloth, e.g., towel, can be made using the method.

10 Claims, 5 Drawing Sheets

(56) References Cited

U.S. PATENT DOCUMENTS

| | | | | | |
|---|---|---|---|---|---|
| 4,124,972 | A * | 11/1978 | Arai | D01H 1/115 | 57/328 |
| 4,888,856 | A * | 12/1989 | Yescheskel | D01G 99/00 | 19/0.27 |
| 5,259,180 | A * | 11/1993 | Nortenius | G02B 6/4479 | 57/264 |
| 5,689,945 | A * | 11/1997 | Tobler | D01H 5/74 | 19/150 |
| 7,310,856 | B2 * | 12/2007 | Temburg | D01H 5/005 | 19/257 |
| 7,500,345 | B2 * | 3/2009 | Kish | B21F 7/00 | 57/138 |
| 8,733,075 | B2 * | 5/2014 | Mandawewala | D02G 3/36 | 139/1 R |
| 2002/0073682 | A1 * | 6/2002 | Greenwood | G02B 6/449 | 57/3 |
| 2008/0104827 | A1 * | 5/2008 | Kish | H01F 5/02 | 29/605 |
| 2012/0076971 | A1 * | 3/2012 | Debnath | D02G 3/04 | 428/85 |
| 2015/0211154 | A1 * | 7/2015 | Hightower, III | D02G 3/36 | 428/221 |
| 2017/0370022 | A1 * | 12/2017 | Wang | D01D 5/24 | |
| 2017/0370028 | A1 * | 12/2017 | Wang | D03D 1/0017 | |

* cited by examiner

METHOD FOR PRODUCING MULTI-HOLE ULTRA SOFT YARNS

CROSS REFERENCE TO RELATED APPLICATION

This application claims benefit to U.S. Provisional Application No. 62/355,581, filed Jun. 28, 2016, entitled "Method for Producing Single-Hole Ultra Soft Yarns and Method for Producing Multi-Hole Ultra Soft Yarns," which is hereby incorporated by reference in its entirety.

TECHNICAL FIELD

The present invention relates to a method for producing multi-hole ultra soft yarns, belonging to the technical field of fiber spinning, and making cloth therefrom.

BACKGROUND OF THE INVENTION

During the exploitation of such yarns, the following three methods are known to introduce PVA fibers into the centre of cotton yarns via a ring spinning system.

The first method is a spinning process in which PVA fibers are put into the core of cotton yarns on a spring frame, and PVA spun yarns are embedded into the streams of cotton fibers in a drafting zone during spinning. Since the cotton fibers in the outer sheath are likely to cluster into bundles during the weaving process, PVA fibers are unevenly spread on the surface of the yarns, resulting in uneven thickness of the yarns and thus insufficient hollowness and softness of towels made of such yarns.

The second method is a spinning process in which PVA fiber slivers (formed by carding) are put into the center of cotton slivers (formed by carding) in a drawing process of a spinning system for purpose of blending. It is unable to ensure that PVA fibers will be evenly wrapped by cotton fibers to form a hollow structure, even if the fibers are evenly blended in this process.

The third method is a process in which PVA slivers are embedded into the center of cotton slivers at a feeding end of the drafting zone of a roving frame, twisted on the roving frame, and then spun. After tests and a number of improvements, this method is regarded as the most hopeful method for achieving hollow PVA. However, only a single-hole hollow structure may be formed due to the restriction of the process.

The present invention provides a method for successively putting water soluble fibers (e.g., PVA) fibers into finish fibers (e.g., cotton fibers) to produce a hollow and ultra soft structure, by putting water soluble slivers into the center of a multi-hole feeder with multiple cotton fiber slivers arranged around the water soluble fiber in a pre-drawing process via a multi-hole sliver feeder. Once a fiber having a single centrally positioned PVA is produced, multiple single PVA fibers can be combined to provide a fiber having multiple water soluble fibers. In addition, fibers having multiple water soluble fibers can be further combined to provide a fiber having an increased number of water soluble fibers, which can subsequently be dissolved. Accordingly, the present invention provides a method of forming a multi-hole fiber.

SUMMARY

According to one aspect of the invention, a method of producing soft yarns comprises the steps of providing a plurality of finish fibers and providing a water soluble fiber. A multi-hole drawing tool is provided. The plurality of finish fibers and the water soluble fiber are introduced into respective holes of the multi-hole drawing tool with the finish fibers arranged around the water soluble fiber. The finish fibers and the water soluble fibers are drawn through the multi-hole drawing tool to form a combined fiber, the combined fiber having the water soluble fiber surrounded by the finish fiber. A plurality of the combined fibers is provided. The plurality of the combined fibers are drawn to form a multi-combined fiber, the multi-combined fiber having multiple water soluble fiber surrounded by the finish fiber. The multi-combined fiber is then roved.

According to a further aspect, the multi-combined fiber is exposed to water to remove the water soluble fiber.

According to another aspect, the finish fiber is cotton.

According to a further aspect, the water soluble fibers are PVA.

According to another aspect, the multi-hole drawing tool includes six holes arranged about a central seventh hole.

According to a yet further aspect, the introducing step includes the steps of passing the water soluble fiber into the central seventh hole and the finish fibers into the other six holes.

According to a yet further aspect, the method includes the step of providing a plurality of the multi-combined fibers. The plurality of the multi-combined fibers are drawn to form a second order multi-combined fiber, the second multi-combined fiber having multiple water soluble fiber surrounded by the finish fiber According to a further aspect, method of manufacturing a cloth is provided that includes the step of weaving the cloth using at least one yarn produced by the methods disclosed above.

According to a further aspect, a cloth is provided that includes at least one yarn produced by the methods disclosed above.

According to a further aspect, a towel is provided that includes at least one yarn produced by the methods disclosed above.

DETAILED DESCRIPTION OF CERTAIN EMBODIMENTS

Figure 1:
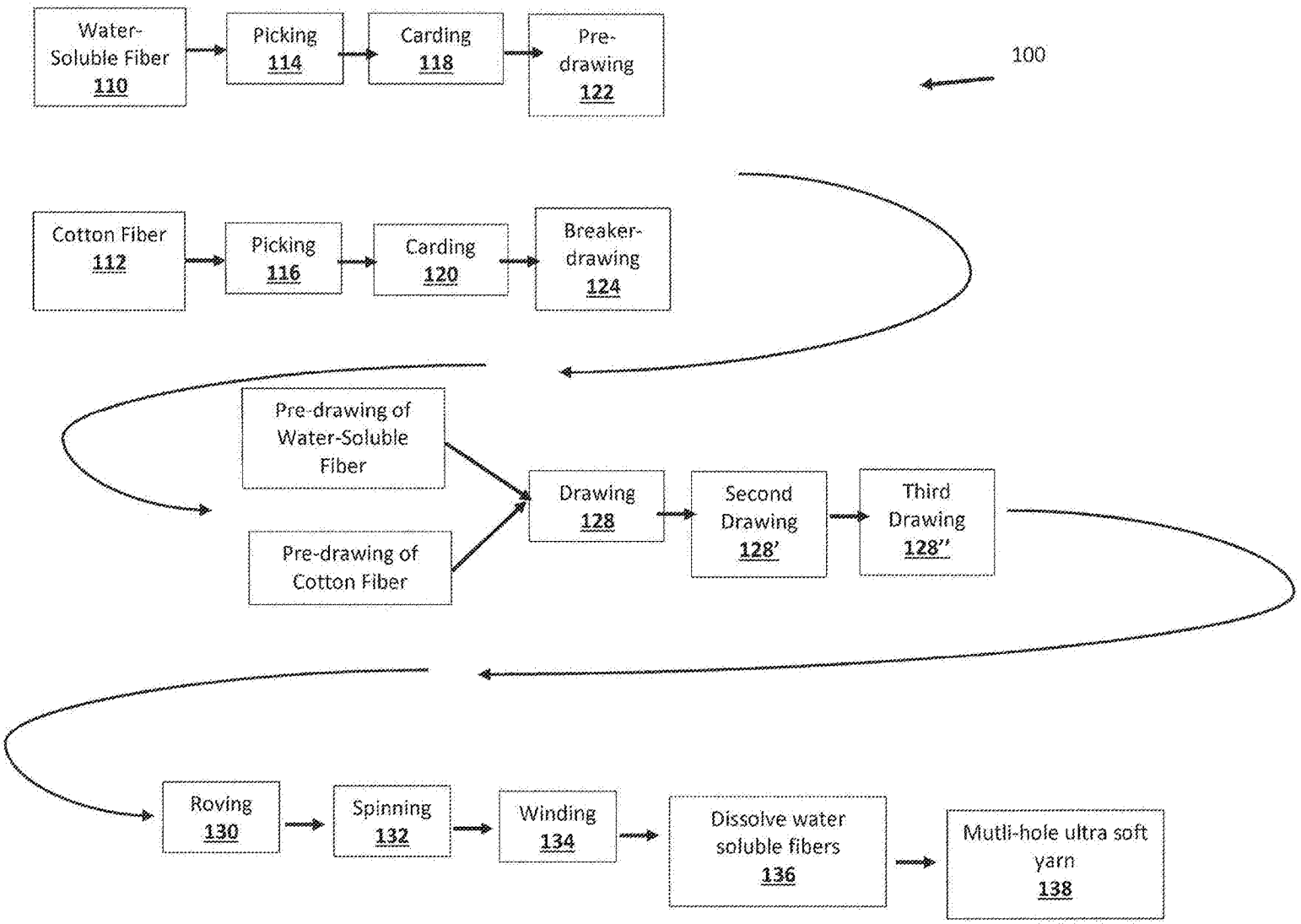
FIG. 1 is a wrapping process of multi-hole ultra soft yarns.

The present invention comprises a method 100 for forming an ultra-soft yarn according to the steps shown in FIG. 1. The process involves the steps of combining a finish fiber and a water soluble fiber and then dissolving the water soluble fiber. The finish fiber is the fiber that remains after the water soluble fiber is dissolved. The process is described herein according to example in which the finish fiber is cotton and the water soluble fiber is PVA. In other example, the finish fiber can be other natural fibers or synthetic fibers and the water soluble can be suitable alternatives to PVA.

At steps 110 and 112, the materials that are to be blended to form the yarn are selected. At step 112, cotton fibers are selected. As one example, the physical indexes of the cotton fibers can be 29 mm or more in length, Micronaire A, short fiber content 10% or less. At step 110, a water soluble fiber is selected. As one example, the water soluble fiber can be PVA fibers having the following characteristics: body length: 38 mm; fineness: 1.33 dtex; dissolution temperature: 90° C. or less. It is desirable to select cotton fibers within the index disclosed or relatively close thereto because if the cotton fibers are far out of the indexes, there is a possibility that cohesion between the cotton fibers during the dissolution of PVA cannot be ensured. As a result, monofilaments can fall off from the yarns and molt rate of towels thus becomes high.

The production process 100 includes two main steps: (1) PVA pre-drawing slivers and cotton card slivers are spun, respectively; and the cotton fiber card slivers and the pre-drawing PVA slivers are fed into an additional 7-hole sliver feeder (see FIG. 3) during a breaker-drawing process, with the PVA fiber slivers into the hole in center and the cotton fiber slivers into the surrounding six holes, and (2) subsequently subjected to stretching, twisting and winding to produce the yarns. The production process 100 and the details surrounding these two main steps are discussed in more detail below.

One example of the process flow is shown in the table below:

Water-soluble fibers: FA002 Disk Plucker→A006B Automatic Blending Machine→A092A Double Hopper Feeder→A076E Lapper→A186D Carding Machine→FA304 Pre-drawing Machine Cotton Fibers: FA002 Disk Plucker→A006B Automatic Blending Machine→FA104 Step Cleaner→A092A Double Hopper Feeder→A076E Lapper→FA201 Carding Machine→FA304 Pre-drawing Machine

| | |
|---|---|
| Pre-drawing of water-soluble fibers<br>Pre-drawing of cotton fibers | FAB304 Drawing Frame (single-hole) → Drawing Frame (multi-hole) → Roving Frame → FA507 Spinning Frame → Savio Automatic Winding Machine → Dissolve water soluble fiber |

Figure 2:
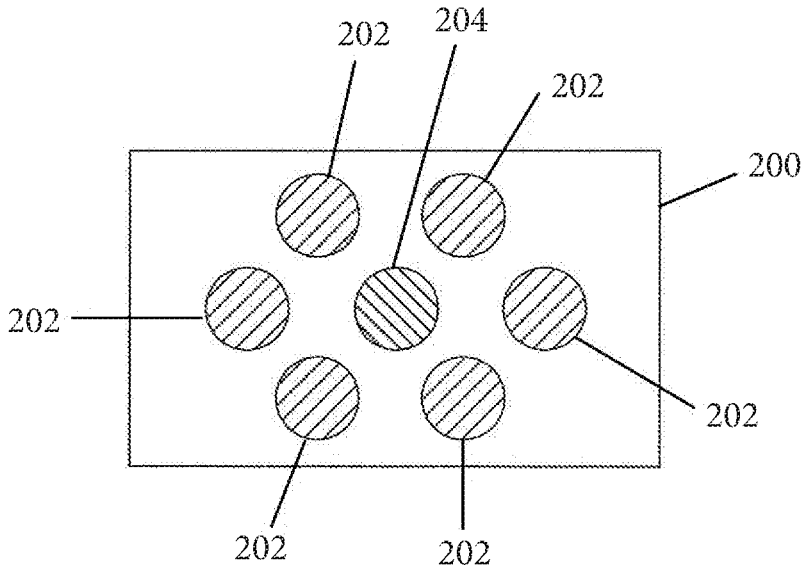
FIG. 2 and are a schematic view of arrangement of cotton fibers and a water-soluble fiber fed during a breaker-drawing process.

The arrangement of the first passage drawn sliver and PVA is: cotton, cotton, cotton, PVA, cotton, cotton, cotton (see, for example, FIG. 2). (This arrangement is required since the apparatus is so designed. The content of cotton can be increased or decreased as long as it is within the range from 70% to 95%, but it is important to ensure that PVA is in the center of cotton slivers).

At steps 114 and 116, the water soluble fibers and cotton fibers, respectively, undergo picking operations. Due to different characteristics of the cotton fibers and the PVA water-soluble fibers, the cotton fibers are blended in two hoppers, with two positions for opening and cleaning, and the PVA fibers are blended in two hoppers, with one position for opening and cleaning. The combined beater is a three-blade combined beater. If the PVA fibers are beaten too much, the fibers may be damaged and kinked. Therefore, as one example, the speed of the combined beater is approximately 1000 rpm/min for the cotton fibers and approximately 820 rpm/min for the PVA fibers, and the gauge between grid bars is minimized to reduce the amount of noils. As one example, the weight of a cotton lap is approximately 400 g/m, and the weight of a PVA fiber lap is approximately 380 g/m.

At steps 118 and 120, the water soluble fibers and cotton fibers, respectively, undergo picking operations. During picking, the PVA fibers can be treated by metal card clothing. To avoid congesting the card clothing, the speed of taker-in is approximately 920 rpm/min during cotton spinning and is approximately 790 rpm/min during PVA fiber spinning. The speed ratio of cylinder to taker-in is approximately 1.7:1 during cotton spinning and is approximately 2.2:1 during PVA fiber spinning. The purpose is to facilitate the transfer of fibers and to reduce damage to the fibers in order to avoid the generation of short fibers. Some gauges are adjusted according to different fibers as shown in the following table:

| | Cotton | PVA fiber |
|---|---|---|
| Feed plate-Taker-in | 7 | 12 |
| Taker-in-dust remover | 12 | 15 |
| Cylinder - Cover | 8/7/7/7/8 | 12/11/10/10/11 (five continuous gauges) |

The unit of those mentioned above is mil.

At steps 122 and 124, the water soluble fibers and cotton fibers, respectively, undergo drawing operations. After these drawing operations, the cotton fibers and water soluble fibers undergo an additional drawing operation at step 128 to blend the fibers, as discussed in more detail below.

A blend ratio for the cotton slivers and the water soluble slivers is selected. As one example, the water soluble fiber (e.g. PVA) is approximately 5% to 30%, and the cotton is approximately 70%-95%. After many tests, an acceptable yarn blending ratio is defined in this range. If the content of PVA is much greater than 30%, the strength of the yarns is too low, resulting in a high molt rate when in use and affecting the wrapped effect of the PVA fibers by the cotton fibers. If the content of PVA is much less than 5%, the single-hole effect provided by the dissolving of the water soluble fiber is insufficient and it is unable to achieve ultra-soft, highly bulky and high absorption effects.

At step 128, the cotton fibers and water soluble fibers undergo a drawing process to blend the fibers such that the cotton fibers are arranged around and surrounding the water soluble fiber. As shown in FIG. 2, the cotton fiber 202 and the PVA fibers 204 are fed into an additional multi-hole drawing tool 200 during a breaker-drawing process, with the water-soluble fiber slivers into the hole in the center and the cotton fiber slivers into the surrounding six holes. The fibers can be subsequently subjected to second and third drawing to wrap the water-soluble fibers. A multi-hole drawing tool 200 is shown, however, feeders with other numbers of holes can be used so long as cotton fibers are arranged to surround a water soluble fiber. In a particular implementation where the multi-hole yarn drawing tool is employed, after the first drawing at step 128, a fiber 300 consisting of cotton fibers surrounding 302 a water soluble fiber 304 is provided as shown in FIG. 7.

In one example, the three-up-three-down press bar drafting process is utilized. When breaker slivers are fed, the cotton and the PVA fibers are fed into an additional multi-hole drawing tool 200 during a breaker-drawing process, with all the cotton fibers 202 in the outer layer and the water-soluble fibers 204 in the inner layer. For both the cotton fibers and the water-soluble fibers, the roller gauge can be approximately 12 mm×20 mm, and the spacer of the press bars is approximately 2.0 mm, for the purpose of enhancing the control on fibers.

Figure 4B:
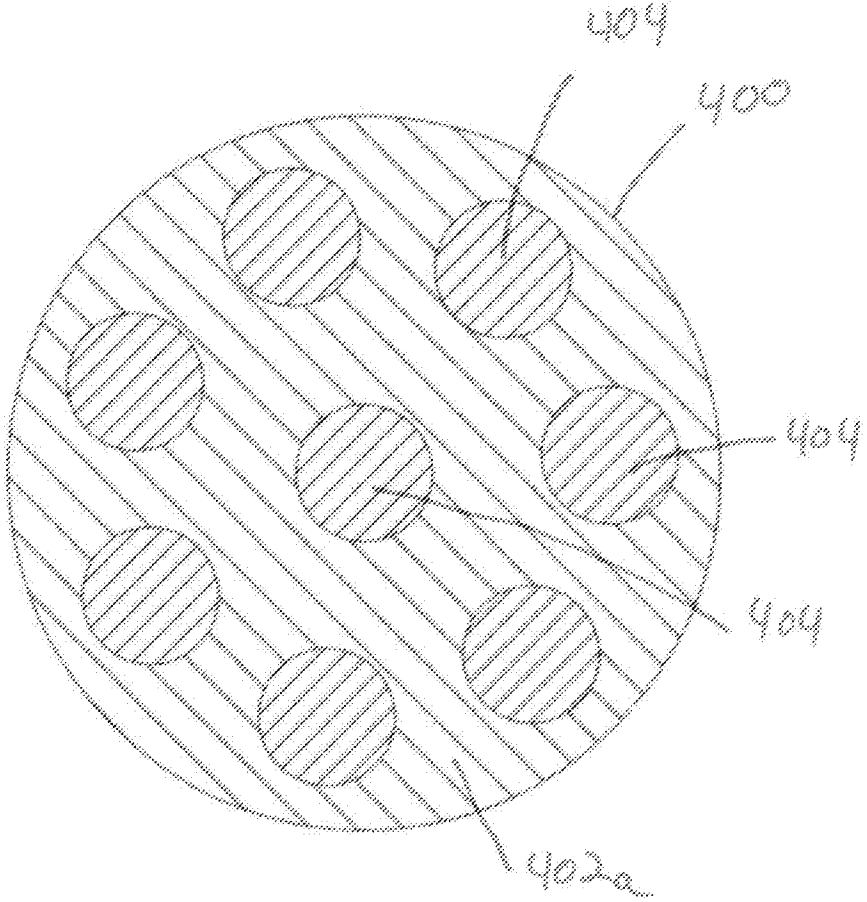
FIGS. 4A and 4B show the multi-hole ultra soft yarns during the second drawing.
Figure 4A:
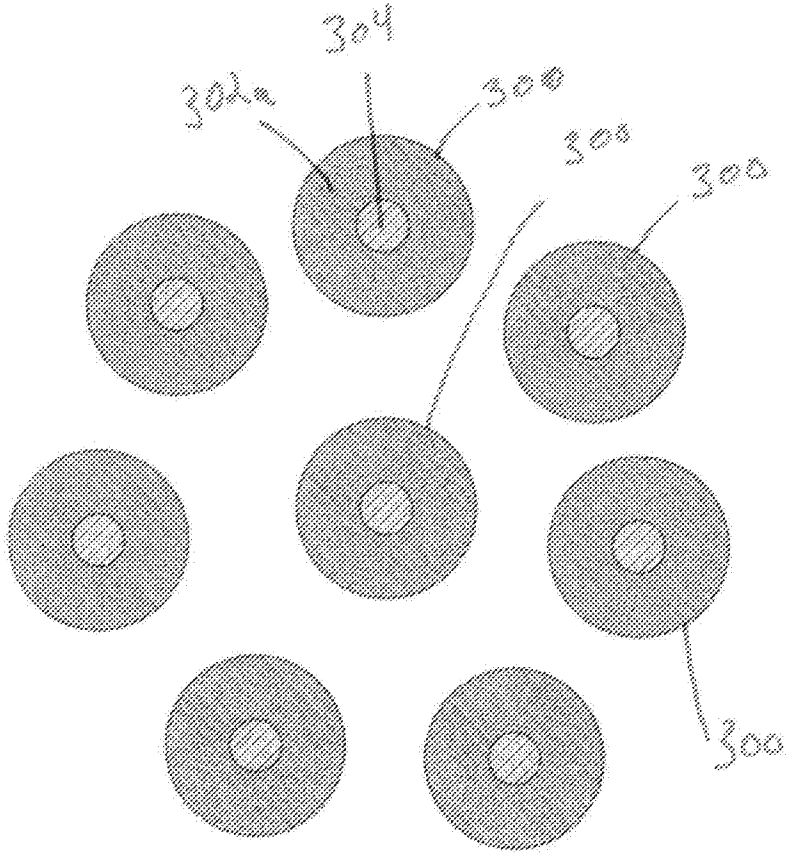

At step 128', a second drawing process is performed in which multiple combined yarns, each having a single central water soluble fiber, are drawn together to provide a combined yarn having multiple water soluble fibers. Multiple combined yarns that were produced as a result of step 128 can be combined to provide a multi-water soluble yarn. As shown in FIG. 4A, multiple combined yarns 300 (for example, eight yarns) each having a single central water soluble fiber 304 surrounding by cotton fiber 302*a* that was combined during step 128. The multiple combined yarns 300 can be drawn to form a multi-water soluble combined yarn 400, as shown in FIG. 4B. The multi-water soluble combined yarn 400 includes multiple water soluble fibers 404 surrounded by cotton fiber 402*a*.

Figure 5B:
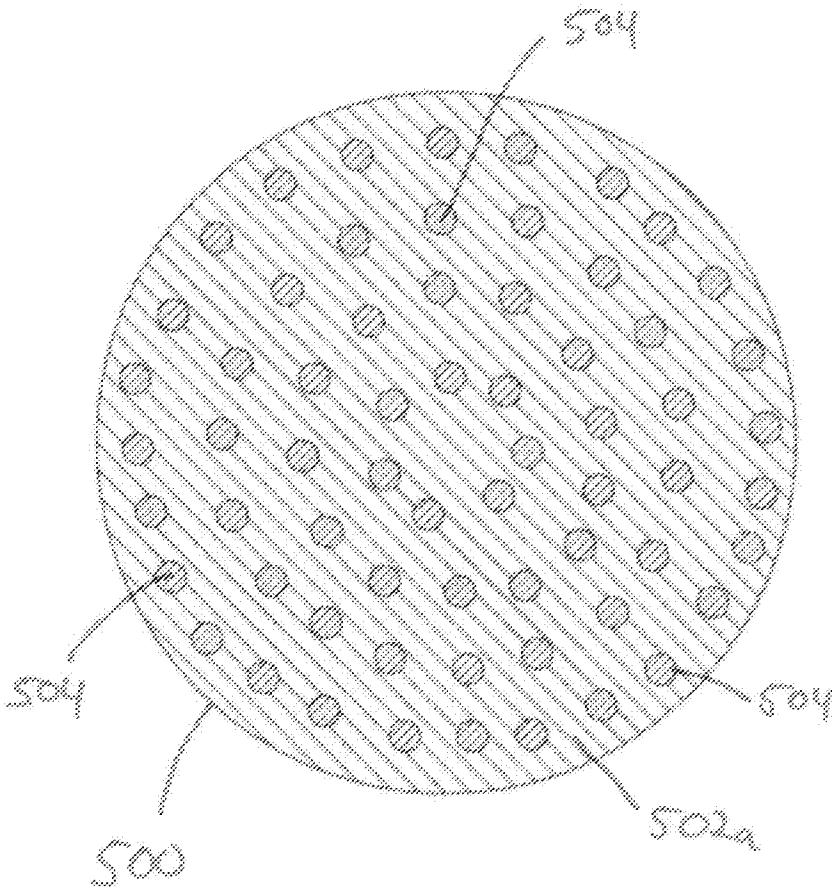
FIGS. 5A and 5B show the multi-hole ultra soft yarns during the third drawing.
Figure 5A:
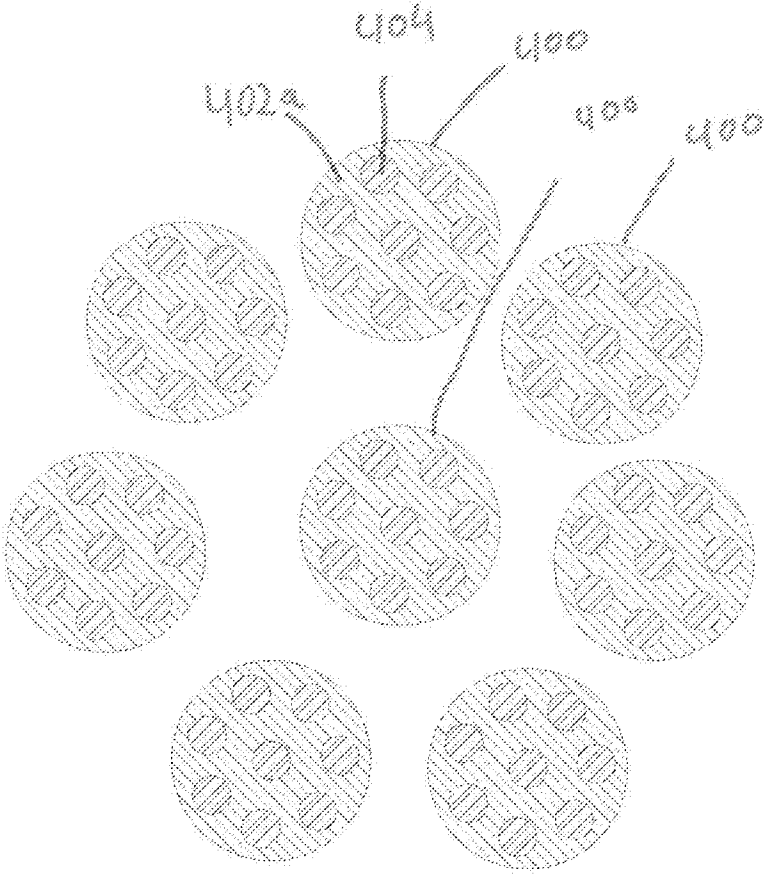

At step 128", a third drawing process can be performed in which multiple combined yarns, each having a multiple water soluble fibers, are drawn together to provide a combined yarn having an even higher number of water soluble fibers. Multiple combined yarns that were produced as a result of step 128' can be combined to provide a multi-water soluble yarn. As shown in FIG. 5A, multiple combined yarns 400 (for example, eight yarns) each having a multiple water soluble fibers 404 surrounding by cotton fiber 402*a* that was combined during step 128'. The multiple combined yarns 400 can be drawn to form a multi-water soluble combined yarn 500 having a higher number of water soluble fibers, as shown in FIG. 5B. The multi-water soluble combined yarn 500 includes multiple water soluble fibers 504 surrounded by cotton fiber 502*a*.

As can be seen in FIGS. 4B and 5B, after each subsequent drawing step more water soluble fibers are introduced into the yarn. As the combined yarn is drawn, however, the diameter of the water soluble fibers is reduced as compared to the overall yarn diameter. Accordingly, a yarn with many, relatively fine water soluble fibers can be manufactured. For ease of reference, the combined yarn 400 can be considered a multi-combined yarn and the combined yarn 500 can be considered a second order multi-combined yarn. As an example, a multi-hole drawing tool similar to multi-hole drawing tool 200 can be used to arrange the fibers during the drawing processes to help ensure proper alignment.

At step 130, the combined cotton and water soluble fibers undergo a roving process. During the roving process, a three-roller double-apron drafting can be utilized. The roving amount can be approximately 5-8 g per 10 m, and the roller gauge can be approximately 26.5 mm×33.5 mm. The dissociated fibers are controlled in the drafting zone. Roving twist factor is defined as 70-90 based on the different proportions of the PVA fibers, the spinning back region process, and other conditions.

At step 132, the combined cotton and water soluble fibers undergo a spinning operation. According to the roving amount and the density of fine yarns, different drawing ratios and twist factors are designed. In one example, the density of fine yarns is 40S-6S. According to the density of fine yarns and the blending ratio, the twist factor is selected from approximately 260 to 400. After drawing the density of fine yarn is approximately 1.20-1.42, and the roller surface gauge is adjusted to approximately 21 mm×28 mm.

At step 134, the combined cotton and water soluble fibers undergo a winding process. The process principle of winding is "small tension, low speed". In order to reduce hairiness and decrease the breaking rate, low speed and small tension are set. A capacitive electronic yarn clearer is used to improve the joint efficiency of the air splicer and reduce the yarn defects. In order to ensure the yarn strength and the moisture regain, the workshop temperature is controlled at approximately 28° C.-32° C., the relative humidity is controlled at approximately 65%-75%, and the winding speed is designed at approximately 900 m/min, all of which enable a better compromise between productivity and quality of cheeses.

Figure 3:
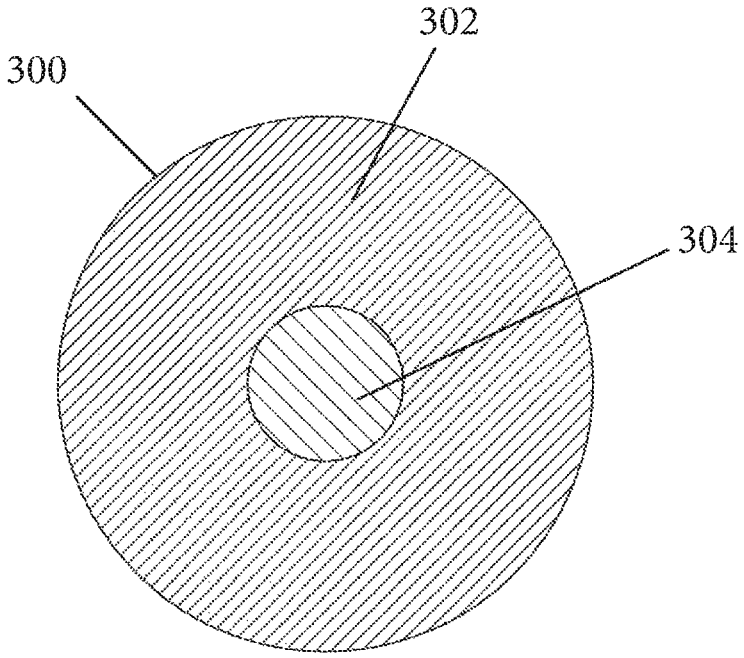
FIG. 3 is a structure diagram of a combined yarn having a single water soluble fiber.

Accordingly, a fiber 300 consisting of cotton fibers surrounding 302 a water soluble fiber 304 is provided as shown in FIG. 3 and FIG. 7. At step 136, the fiber 300 is exposed to warm water to dissolve the water soluble fiber 304. This process results in a cotton fiber with a hollow core, which is soft and absorbent, as in step 138. The water dissolving step can be performed after the combined fiber has been manufactured into an article (e.g., towel, garment, etc.).

Six cotton fibers and one water-soluble fiber are fed into a breaker-drawing frame, with the cotton fibers being evenly spread around the water-soluble fiber to completely wrap the water-soluble fiber. In such a feeding mode, the cotton fibers are in the outer layer and the water-soluble fiber in the inner layer. Subsequently, by drawing and drafting, the water-soluble fiber is further dispersed in the cotton fibers. When the water soluble fibers are dissolved, multiple fine voids are formed at the locations of the water soluble fibers.

The following chart illustrates differences and performance improvements between the yarn of the present invention and prior art yarns.

Performance comparison between yarns obtained by the present invention and yarns obtained by the prior art

| Method and performance comparison | Yarns obtained by the present invention | Yarns obtained by the prior art |
|---|---|---|
| Spinning Method | Putting PVA slivers in the center of the yarn slivers | Blending PVA fibers and cotton in hoppers<br>Ordinarily blending PVA slivers and cotton slivers |
| Structure | PVA fibers can tend to be continuously present in the center of the yarn body, not exposed to the surface; and after completely removing the PVA, voids in the yarn body are larger and more uniform. | Most of PVA fibers exposed to the yarn body; and after removing the water-soluble fiber, micropores are not continuous. |
| Bulkiness | good | normal |
| Quick-drying | good | normal |
| Softness | better | normal |
| Resultant yarns | By using a number of different cotton slivers during the second drawing, a multi-hole ultra soft yarn structure is formed. | By putting PVA fibers in the center of yarns, a hollow structure is formed. |
| Formation process | Pre-drawing<br>In the resulting multi-hole yarn structure, all PVA fibers are evenly distributed in the yarns, so that the yarns are bulky and low in the molt rate even after many times of washing. | Pre-drawing<br>Since there is no yarn guide means, the distribution of PVA fibers in the cotton yarns is uneven and this may lead to yarn unevenness; the thickness of the cotton yarns after dissolved off PVA is uneven; and the molt rate is high. |

The method of the present invention can be used to manufacture cloth that can be manufactured into various article, such as ultra soft towels. Accordingly, card slivers are produced from cotton fibers by picking and carding and pre-drawing silvers are produced from PVA fibers by picking, carding and pre-drawing. The cotton fiber card slivers and the pre-drawing PVA silvers are fed into an additional multi-hole sliver feeder during a breaker-drawing process, with the PVA fiber slivers into the hole in center and the cotton fiber slivers into the surrounding six holes, and subsequently subjected to stretching, twisting and winding to produce the yarns. The yarns are then feed through additional drawing steps which combined the single water soluble fiber yarn into a yarn having multiple water soluble fibers surrounded by cotton fibers. When towels made of such yarns are placed into hot water, PVA fibers are dissolved to form a single-hole ultra soft cotton ring structure.

Grey cloth is produced from the multi-hole ultra soft yarn via a towel loom, and then fed into a combined desizing-scouring machine where PVA fibers are dissolved in hot water at 40° C.-100° C., and the PVA is completely removed by multiple times of washing. The grey cloth, which is removed off PVA fibers by washing, is subjected to scouring and bleaching, dyeing, soap boiling, softening, drying, stitching and finishing to produce a multi-hole ultra soft towel.

A finished towel made of such multi-hole ultra soft yarns is lightweight, plump and flexible, and can keep the softness for a long period of time. A towel made of such multi-hole ultra soft yarns is lighter, and higher in absorbance. Such multi-hole ultra soft yarns are preferred raw materials for weaving towels. A high-quality towel made of such multi-hole ultra soft yarns is bounded with fine satin, exhibiting high taste.

The invention claimed is:

1. A method of producing soft yarns, comprising the steps of:

receiving from a first pre-drawing machine a plurality of finish fibers;

receiving from a second pre-drawing machine a water soluble fiber;

providing a first multi-hole drawing tool, the multi-hole drawing tool having a first planar surface and a second planar surface and a center passage disposed therethrough and configured to allow the passage of the water soluble fiber from the first planar surface to the second planar surface, and at least two finish fibers passages at a distance from the center passage and disposed the first and second planar surfaces and configured to allow passage of one of the at least two finish fibers of the plurality of finish fibers in each respective finish fiber passage;

introducing the plurality of finish fibers and the water soluble fiber into respective holes of the multi-hole drawing tool with the finish fibers arranged around the water soluble fiber;

pulling the finish fibers and the water soluble fiber through the multi-hole drawing tool to form a combined fiber, the combined fiber having the water soluble fiber surrounded by the finish fiber;

producing, prior to a speed frame process, a multi-combined fiber by:

providing a plurality of combined fibers;

drawing the plurality of the combined fibers through a second multi-hole drawing tool, the second multi-hole drawing tool having a first planar surface and a second planar surface disposed opposite the first planar surface and a center passage disposed therethrough and configured to allow the passage of one of the plurality of combined fibers, and at least two secondary combined fibers passages at a distance from the center passage and disposed the first and second planar surfaces and configured to allow passage of one of the at least two combined fibers in each respective finish fiber passage so as to form a multi-combined fiber, the multi-combined fiber having multiple water soluble fiber surrounded by the finish fiber; and roving the multi-combined fiber.

2. The method of claim 1, further including the step of exposing the multi-combined fiber to water to remove the multiple water soluble fibers.

3. The method of claim 1, wherein the finish fiber is cotton.

4. The method of claim 1, wherein the water soluble fibers are PVA.

5. The method of claim 1, wherein the multi-hole drawing tool includes six passages arranged about a central seventh hole.

6. The method of claim 5, wherein introducing step includes the step of generating a yarn from the multi-combined fiber.

7. The method of claim 1, further including the steps of:

providing a plurality of the multi-combined fibers;

drawing the plurality of the multi-combined fibers to form a second order multi-combined fiber, the second multi-combined fiber having multiple water soluble fiber surrounded by the finish fiber.

8. A method of manufacturing a cloth, comprising the steps of:

weaving the cloth using at least one yarn produced by the method of claim 6.

9. The method of claim 6, further comprising incorporating at least one generated yarn into a cloth.

10. The method of claim 6, further comprising incorporating at least one generated yarn into a towel.

* * * * *